US012024866B2

(12) United States Patent
Zhou et al.

(10) Patent No.: US 12,024,866 B2
(45) Date of Patent: Jul. 2, 2024

(54) KITCHEN FAUCET

(71) Applicant: Xiamen Lota International Co., Ltd., Fujian (CN)

(72) Inventors: Jianping Zhou, Fujian (CN); Shaofeng Li, Fujian (CN); Liming Ye, Fujian (CN); Chuanbao Zhu, Fujian (CN)

(73) Assignee: Xiamen Lota International Co., Ltd., Fujian (CN)

( * ) Notice: Subject to any disclaimer, the term of this patent is extended or adjusted under 35 U.S.C. 154(b) by 181 days.

(21) Appl. No.: 17/724,805

(22) Filed: Apr. 20, 2022

(65) Prior Publication Data

US 2023/0140780 A1 May 4, 2023

(30) Foreign Application Priority Data

Oct. 29, 2021 (CN) ..... 202122636203.8

(51) Int. Cl.
*E03C 1/04* (2006.01)

(52) U.S. Cl.
CPC ..... *E03C 1/0405* (2013.01); *E03C 1/04* (2013.01); *E03C 1/0403* (2013.01); *E03C 1/0404* (2013.01); *E03C 2001/0415* (2013.01); *E03C 2201/40* (2013.01); *Y10T 137/9464* (2015.04)

(58) Field of Classification Search
CPC ..... E03C 1/0405; E03C 1/04; E03C 1/0403; E03C 1/0404; E03C 2001/0415; E03C 2201/40; Y10T 137/9464
USPC ..... 137/801
See application file for complete search history.

(56) References Cited

U.S. PATENT DOCUMENTS

| | | | | |
|---|---|---|---|---|
| 5,173,178 | A * | 12/1992 | Kawashima | E03C 1/04 210/138 |
| 10,183,871 | B2 * | 1/2019 | Ye | E03C 1/023 |
| 10,227,758 | B2 * | 3/2019 | Tang | E03C 1/044 |
| 10,450,203 | B2 * | 10/2019 | Schuster | C02F 1/003 |
| 2009/0211654 | A1 * | 8/2009 | Nobili | F16L 39/02 138/118 |
| 2013/0112903 | A1 * | 5/2013 | Conan | E03C 1/052 251/129.15 |

FOREIGN PATENT DOCUMENTS

| | | |
|---|---|---|
| CN | 211288924 U | 8/2020 |
| WO | WO 2020167717 A1 * | 8/2020 |

* cited by examiner

*Primary Examiner* — John Bastianelli
(74) *Attorney, Agent, or Firm* — Cooper Legal Group LLC

(57) ABSTRACT

A kitchen faucet comprises a faucet body, a control valve, a solenoid valve, and a pull-out head. The faucet body comprises a first water inlet pipe, a second water inlet pipe, a first water outlet pipe configured to be in communication with the first water inlet pipe, and a second water outlet pipe configured to be in communication with the second water inlet pipe. The pull-out head is pluggably matched with the faucet body and is in communication with the first water outlet pipe. The control valve is disposed on the faucet body and is configured to control the first water outlet pipe to be opened and closed, and the solenoid valve is disposed on the second water inlet pipe to control the second water outlet pipe to be opened and closed.

7 Claims, 5 Drawing Sheets

KITCHEN FAUCET

RELATED APPLICATIONS

This application claims priority to Chinese patent application number 202122636203.8, filed on Oct. 29, 2021. Chinese patent application number 202122636203.8 is incorporated herein by reference.

FIELD OF THE DISCLOSURE

The present disclosure relates to a kitchen faucet.

BACKGROUND OF THE DISCLOSURE

The traditional faucet only has a single water path structure, and the single water path structure is controlled by a single valve to achieve switching, which has a relatively simple water outlet function.

For example, Chinese patent application number 201921346078.3 discloses a dual-purpose faucet for kitchen and water purification, comprising a faucet body, a water purifier, a touch screen assembly, a handle, and a control valve. The faucet body comprises a tap water path and a purified water path. The control valve is installed on the faucet body and can control a turning ON and OFF of the tap water path and a flow rate of water that is flowing in the tap water path. The handle can move relative to the faucet body and is operatively coupled to the control valve. The touch screen assembly comprises a touch screen, a control circuit for the touch screen, and a solenoid valve. The purified water path passes through the water purifier and the solenoid valve. The touch screen is fixed on the faucet body, is located outside the control valve, and is arranged coaxially with the control valve. The control circuit is installed on the faucet body and is electrically connected to each of the touch screen and the solenoid valve. The solenoid valve is electrically connected with the water purifier. Although the dual-purpose faucet has two independent water pipes, the faucet body is fixed, the two water pipes cannot be rotated according to the required positions, and the two water pipes cannot be pulled out for changing a water outlet direction of the two independent water pipes, which is inconvenient for a user.

BRIEF SUMMARY OF THE DISCLOSURE

The present disclosure provides a kitchen faucet to solve the deficiencies in the background.

In order to solve the technical problem, a first technical solution of the present disclosure is as follows.

A kitchen faucet comprises a faucet body, a control valve, a solenoid valve, and a pull-out head. The faucet body comprises a first water inlet pipe, a second water inlet pipe, a first water outlet pipe configured to be in communication with the first water inlet pipe, and a second water outlet pipe configured to be in communication with the second water inlet pipe. The pull-out head is pluggably matched with the faucet body and is in communication with the first water outlet pipe. The control valve is disposed on the faucet body and is configured to control the first water outlet pipe to be opened and closed, and the solenoid valve is disposed on the second water inlet pipe to control the second water outlet pipe to be opened and closed.

In a preferred embodiment, the faucet body comprises a faucet housing, a bent tube, and a first dividing member. The bent tube is rotatably connected to the faucet housing. The first dividing member is located at a junction of the faucet housing and the bent tube and comprises a dividing sleeve and a dividing guide rail fixedly connected to the dividing sleeve. The first water outlet pipe extends toward the bent tube after passing through the dividing sleeve, and the second water outlet pipe extends toward the bent tube along the dividing guide rail after passing through the dividing sleeve.

In a preferred embodiment, the dividing guide rail is elastic.

In a preferred embodiment, the faucet body further comprises a second dividing member. The second dividing member is fixedly connected to a distal end of the bent tube and comprises a receiving cavity and an insertion hole. The pull-out head is pluggably matched with the receiving cavity, and the second water outlet pipe is connected with the insertion hole.

In a preferred embodiment, the faucet body further comprises a fixed sleeve and a bushing. The fixed sleeve is fixedly connected to the faucet housing, the bushing is rotatably sleeved on an outer periphery of the fixed sleeve and is snapped to and matched with the bent tube, and the first dividing member is located above the fixed sleeve.

In a preferred embodiment, the faucet body further comprises a sealing member. An outer periphery of a top end of the fixed sleeve comprises an annular groove, and the sealing member is sleeved in the annular groove and is sealingly connected to an inner wall of the bent tube.

In a preferred embodiment, the faucet body further comprises a valve body, and the valve body is fixedly connected to an inside of the faucet housing. Each of the first water inlet pipe and the first water outlet pipe is connected to the valve body, and the control valve is matched with a side surface of the valve body.

In a preferred embodiment, a water purifier is disposed on the second water inlet pipe.

Compared with the existing techniques, the technical solution has the following advantages.

1. The kitchen faucet not only has two independently controlled water outlet pipes, the first water outlet pipe is controlled by the control valve, and the second water outlet pipe is controlled by the solenoid valve, which are independent of each other, so that a control effect of the kitchen faucet is good and the kitchen faucet is convenient for users to use. Furthermore, the first water outlet pipe is connected with the pull-out head. That is, the kitchen faucet also has a pull-out function, which is more convenient for users to use.

2. The first water outlet pipe extends toward the bent tube after passing through the dividing sleeve, and the second water outlet pipe extends toward the bent tube along the dividing guide rail after passing through the dividing sleeve. That is, the dividing guide rail separates the first water outlet pipe from the second water outlet pipe to avoid interference of the second water outlet pipe with the first water outlet pipe while the pull-out head is being pulled out. At the same time, a structure of the first dividing member is relatively simple, does not occupy too much space in the bent tube, and is more concise.

3. The dividing guide rail is made of elastic material, which can avoid friction with the first water outlet pipe and improve the service life of the first water outlet pipe.

4. The second dividing member separates the pull-out head from the distal end of the second water outlet pipe, again ensuring that the first water outlet pipe and the second water outlet pipe do not interfere with each other.

DETAILED DESCRIPTION OF THE EMBODIMENTS

Figure 1:
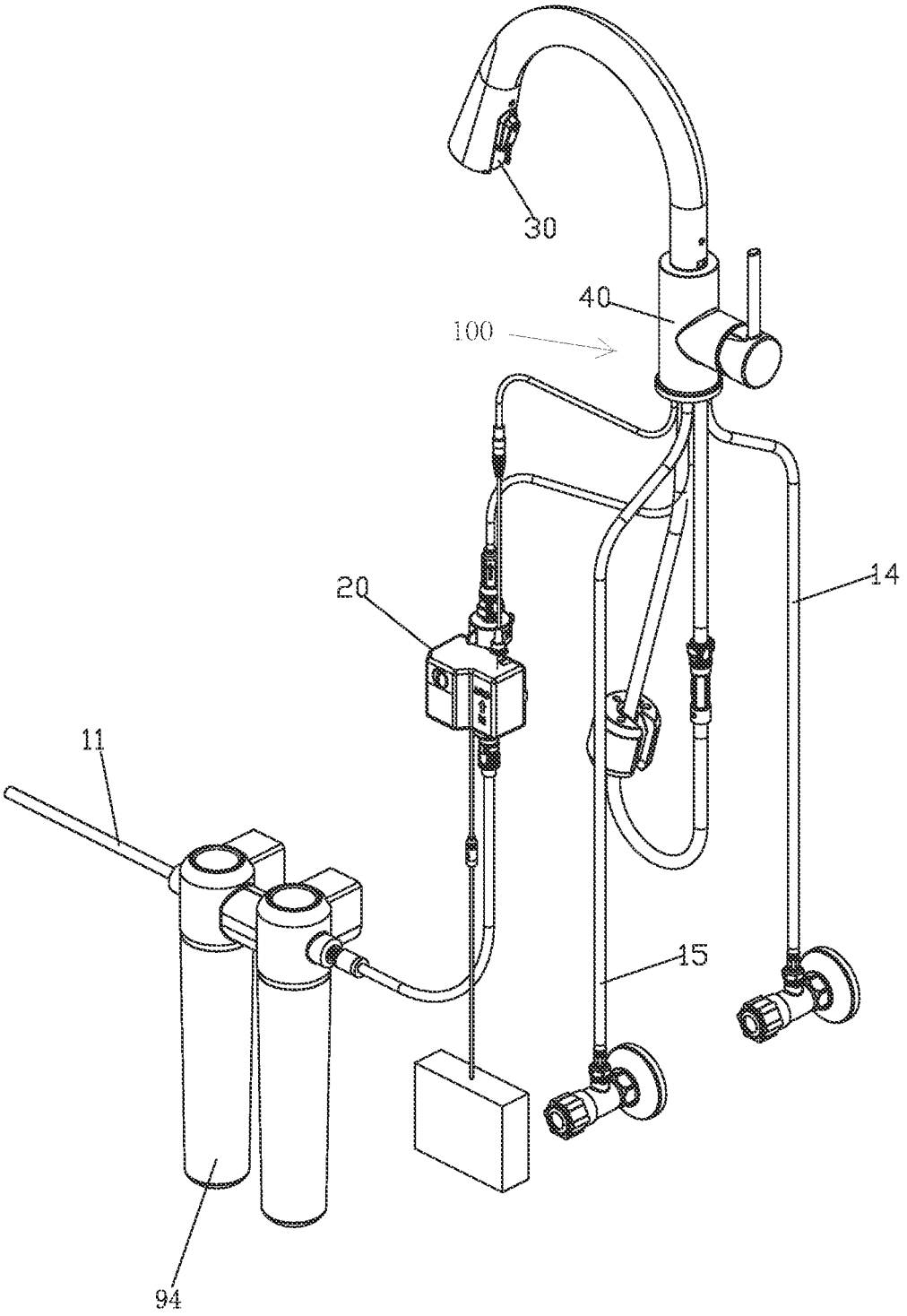
FIG. 1 illustrates an overall, perspective view of a kitchen faucet in a preferred embodiment.
Figure 2:
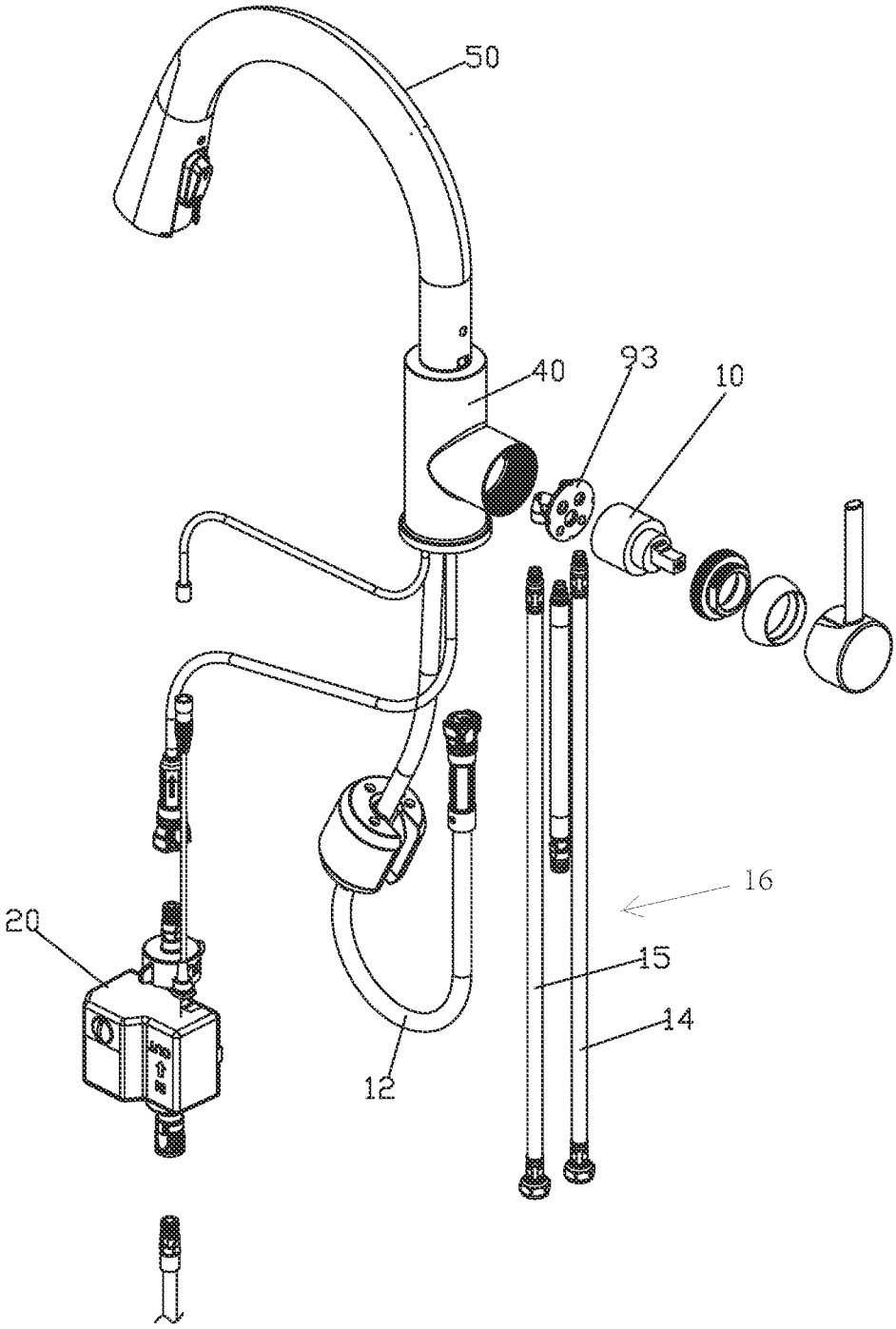
FIG. 2 illustrates an exploded view of the kitchen faucet in a preferred embodiment.

The present disclosure will be further described below in combination with the accompanying drawings and embodiments.

Unless otherwise clearly defined in the claims, description, and the above-mentioned drawings of the disclosure, the terms "first", "second", "third", and so on are used to distinguish different objects, not used to describe a specific order.

Unless otherwise clearly defined in the claims, description, and the above-mentioned drawings of the disclosure, for location words, such as the use of the terms "center", "transverse", "perpendicular", "horizontal", "vertical", "top", "bottom", "inner", "outer", "upper", "lower", "front", "rear", "left", "right", "clockwise", "counterclockwise", and other indication orientations or positional relationships are based on the orientations and positional relationships shown in the drawings, are provided to facilitate the description of the disclosure and simplify the description, and are not intended to indicate or imply that the indicated device or element must have a specific orientation or be constructed and operated in a specific orientation. Such words should not be understood as limiting the specific protection scope of the disclosure.

In the claims, the description, and the drawings of the present disclosure, unless otherwise explicitly defined, if the term "fixed connection" or "fixedly connected" is used, it should be understood in a broad sense. That is, any connection method without displacement relationship and relative rotation relationship between the two, that is, including non-removable fixed connection, removably fixed connection, connected as a whole, and fixed connection through other devices or components.

In the claims, the description, and the drawings of the present disclosure, the terms "including", "having", and their variations are intended to mean "including but not limited to".

Referring to FIGS. 1 to 5, a preferred embodiment of a kitchen faucet is provided. The kitchen faucet comprises a faucet body 100, a control valve 10, a solenoid valve 20, and a pull-out head 30.

The faucet body 100 comprises a first water inlet pipe 16, a second water inlet pipe 11, a first water outlet pipe 12 configured to be in communication with the first water inlet pipe 16, and a second water outlet pipe 13 configured to be in communication with the second water inlet pipe 11. The pull-out head 30 is pluggably matched with the faucet body 100 and is in communication with the first water outlet pipe 12. The control valve 10 is disposed in the faucet body 100 and can control the first water outlet pipe 12 to be opened and closed. The solenoid valve 20 is disposed on the second water inlet pipe 11 to control the second water outlet pipe 13 to be opened and closed. The kitchen faucet therefore has two water outlet pipes which are respectively, independently controlled by the control valve 10 and the solenoid valve 20. The first water outlet pipe 12 is controlled by the control valve 10, and the second water outlet pipe 13 is controlled by the solenoid valve 20, which are independent of each other and have good control effect and are convenient for users to use. In addition, the first water outlet pipe 12 is connected with the pull-out head 30, and the kitchen faucet also has a pull-out function that enables the pull-out head 30 to be pulled out to change a water outlet direction of the pull-out head 30, which is more convenient for users to use.

In this embodiment, the first water inlet pipe 16 comprises a cold water inlet pipe 14 and a hot water inlet pipe 15, and the control valve 10 is connected to each of the cold water inlet pipe 14 and the hot water inlet pipe 15 to have a function of regulating temperature and controlling a flow rate of water that flows from the control valve 10.

Figure 3:
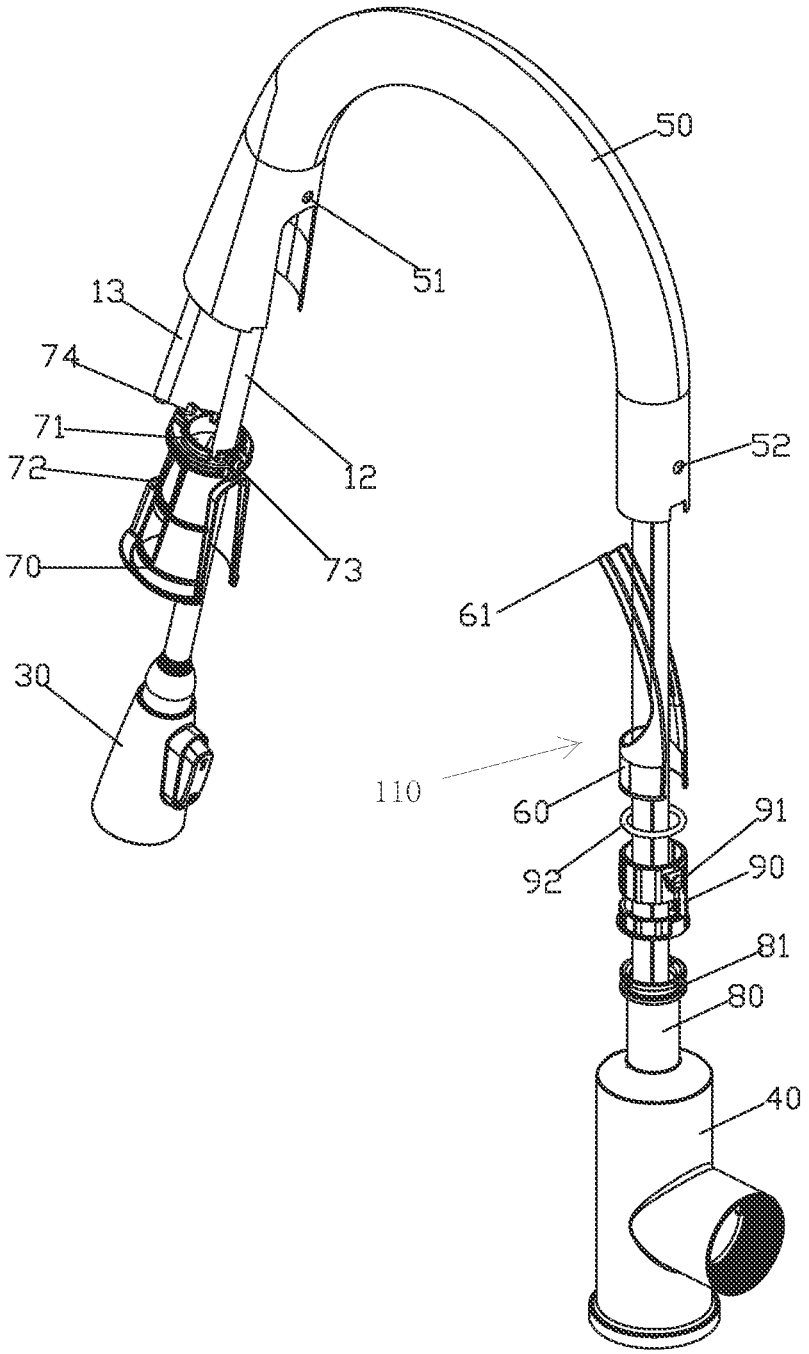
FIG. 3 illustrates an exploded view of the kitchen faucet in a preferred embodiment, illustrating a faucet housing, a bent tube, a first dividing member, a second dividing member, and a bushing.
Figure 4:
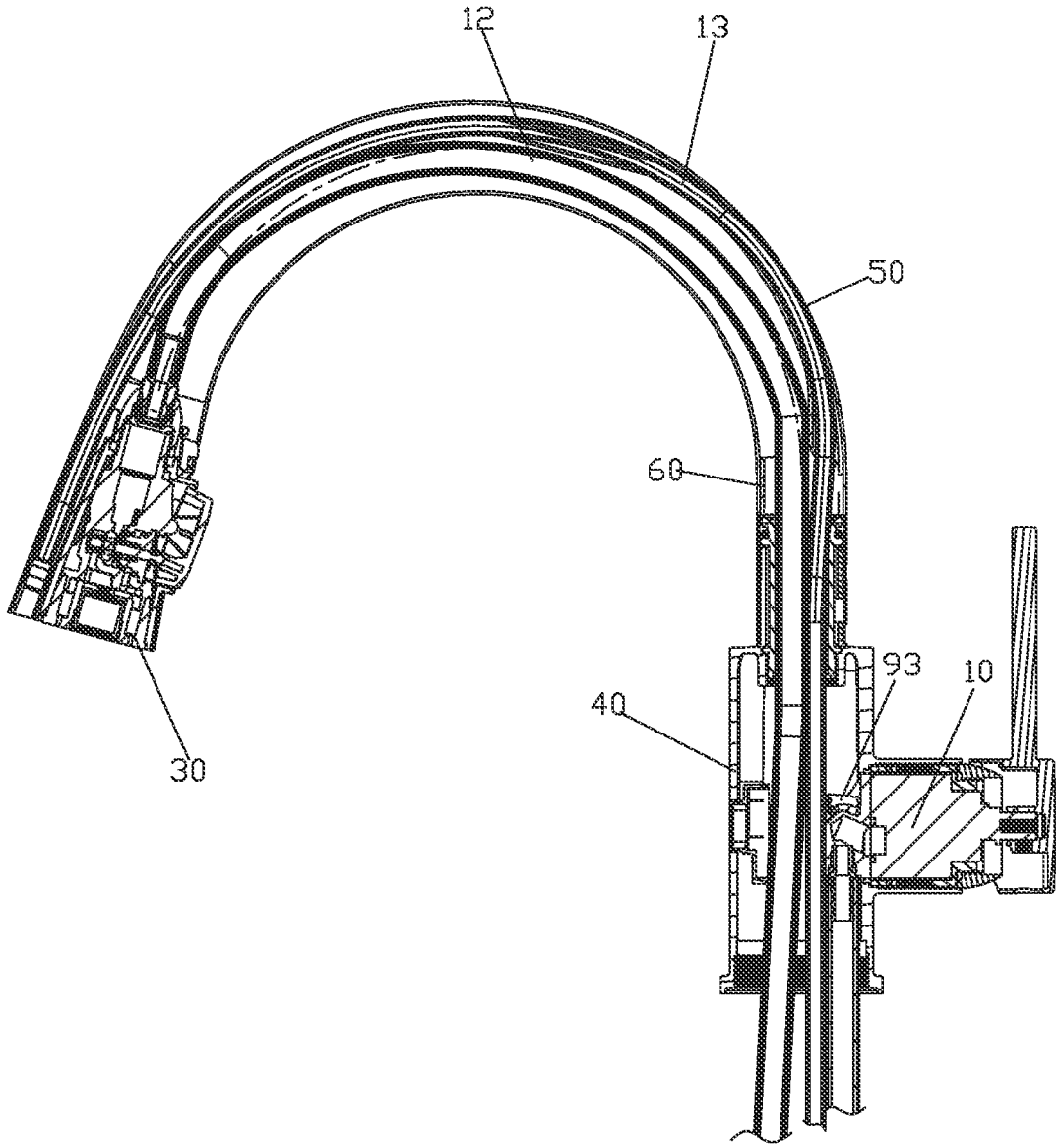
FIG. 4 illustrates a cross-sectional view of a faucet body in a preferred embodiment.
Figure 5:
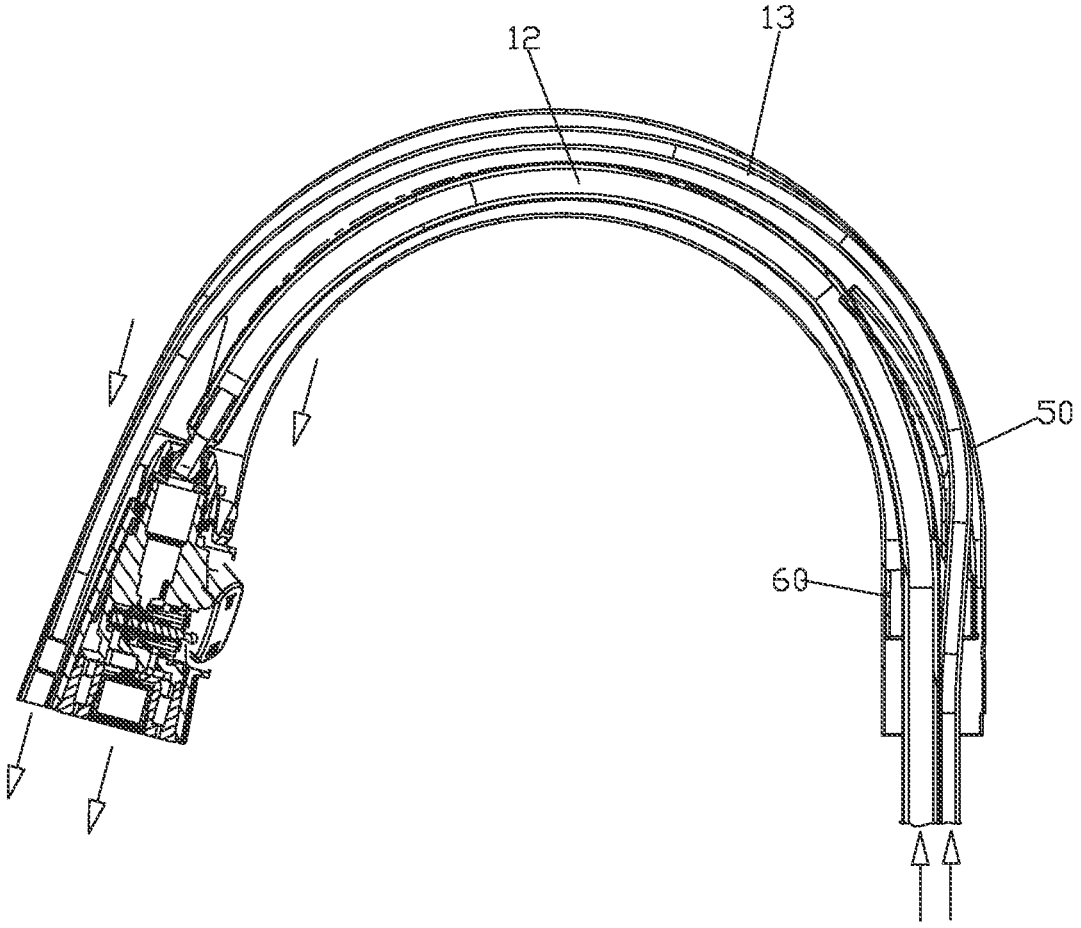
FIG. 5 illustrates a cross-sectional view of the faucet body in a preferred embodiment, illustrating the bent tube, the first dividing member, the second dividing member, a first water outlet pipe, and a second water outlet pipe.

In this embodiment, referring to FIG. 3, the faucet body 100 comprises a faucet housing 40, a bent tube 50, and a first dividing member 110. The bent tube 50 is rotatably connected to the faucet housing 40, and the first dividing member 110 is located at a junction of the faucet housing 40 and the bent tube 50. The first dividing member 110 comprises a dividing sleeve 60 and a dividing guide rail 61 fixedly connected to the dividing sleeve 60. The first water outlet pipe 12 passes through the dividing sleeve 60 and then extends toward the bent tube 50. The second water outlet pipe 13 passes through the dividing sleeve 60 and then extends toward the bent tube 50 along the dividing guide rail 61. Since the first water outlet pipe 12 needs to be pulled back and forth, the dividing guide rail 61 is made of elastic material, which can avoid large friction between the first water outlet pipe 12 and the dividing guide rail 61, thereby improving a useful life of the first water outlet pipe 12.

In this embodiment, the faucet body 100 further comprises a second dividing member 70. The second dividing member 70 is fixedly connected to a distal end of the bent tube 50 and comprises a receiving cavity 71 and an insertion hole 72. The pull-out head 30 is pluggably matched with the receiving cavity 71, and the second water outlet pipe 13 is inserted into and matched with the insertion hole 72.

Specifically, referring to FIG. 3, an outer periphery of the second dividing member 70 comprises an elastic latching protrusion 73, and the distal end of the bent tube 50 comprises a latching groove 51. The second dividing member 70 is fixedly connected to the bent tube 50 through the elastic latching protrusion 73 being snapped to and matched with the latching groove 51. In addition, the second dividing member 70 further comprises a position-limiting groove 74. The second water outlet pipe 13 passes through the position-limiting groove 74 and then is inserted into and matched with the insertion hole 72.

In this embodiment, the faucet body 100 further comprises a fixed sleeve 80 and a bushing 90. The fixed sleeve 80 is fixedly connected to the faucet housing 40. The bushing 90 is rotatably sleeved on an outer periphery of the fixed sleeve 80, and the bushing 90 is snapped to and matched with the bent tube 50. The first dividing member 110 is located above the fixed sleeve 80. The bushing 90 comprises an elastic buckle 91, and the bent tube 50 comprises a buckle hole 52. When a bottom end of the bent tube 50 is inserted into an outer periphery of the bushing 90, the elastic buckle 91 and the buckle hole 52 can be snapped to each other to ensure that the bent tube 50 is fixed with respect to the bushing 90.

In this embodiment, the faucet body 100 further comprises a sealing member 92. An outer periphery of a top end of the fixed sleeve 80 comprises an annular groove 81. The sealing member 92 is sleeved in the annular groove 81 and is sealingly connected to an inner wall of the bent tube 50.

In this embodiment, the faucet body 100 further includes a valve body 93, and the valve body 93 is fixedly connected to an inside of the faucet housing 40. Each of the first water inlet pipe 16 and the first water outlet pipe 12 is inserted into and matched with the valve body 93. The control valve 10 is matched with a side surface of the valve body 93.

In this embodiment, a water purifier 94 is disposed on the second water inlet pipe 11, and the water purifier 94 is located upstream of the solenoid valve 20.

Although the kitchen faucet comprises two water outlet pipes which are independent of each other, through an effective separation of the first dividing member 110 and the second dividing member 70, there will be no interference between the first water outlet pipe 12 and the second water outlet pipe 13, which ensures a normal use of the pull-out head 30 and increases the useful life.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A kitchen faucet, comprising:

a faucet body, a control valve, a solenoid valve, and a pull-out head, wherein:

the faucet body comprises a first water inlet pipe, a second water inlet pipe, a first water outlet pipe configured to be in communication with the first water inlet pipe, and a second water outlet pipe configured to be in communication with the second water inlet pipe, the pull-out head is pluggably matched with the faucet body and is in communication with the first water outlet pipe, the control valve is disposed on the faucet body and is configured to control the first water outlet pipe to be opened and closed, the solenoid valve is disposed on the second water inlet pipe to control the second water outlet pipe to be opened and closed, the faucet body comprises a faucet housing, a bent tube, and a first dividing member, the bent tube is rotatably connected to the faucet housing, the first dividing member is located at a junction of the faucet housing and the bent tube and comprises a dividing sleeve and a dividing guide rail fixedly connected to the dividing sleeve, the first water outlet pipe extends toward the bent tube after passing through the dividing sleeve, and the second water outlet pipe extends toward the bent tube along the dividing guide rail after passing through the dividing sleeve.

2. The kitchen faucet according to claim 1, wherein:

the dividing guide rail is elastic.

3. The kitchen faucet according to claim 1, wherein:

the faucet body further comprises a second dividing member, the second dividing member is fixedly connected to a distal end of the bent tube and comprises a receiving cavity and an insertion hole, the pull-out head is pluggably matched with the receiving cavity, and the second water outlet pipe is connected with the insertion hole.

4. The kitchen faucet according to claim 1, wherein:

the faucet body further comprises a fixed sleeve and a bushing, the fixed sleeve is fixedly connected to the faucet housing, the bushing is rotatably sleeved on an outer periphery of the fixed sleeve and is snapped to and matched with the bent tube, and the first dividing member is located above the fixed sleeve.

5. The kitchen faucet according to claim 4, wherein:

the faucet body further comprises a sealing member, an outer periphery of a top end of the fixed sleeve comprises an annular groove, and the sealing member is sleeved in the annular groove and is sealingly connected to an inner wall of the bent tube.

6. The kitchen faucet according to claim 1, wherein:

the faucet body further comprises a valve body, the valve body is fixedly connected to an inside of the faucet housing, each of the first water inlet pipe and the first water outlet pipe is connected to the valve body, and the control valve is matched with a side surface of the valve body.

7. The kitchen faucet according to claim 1, wherein:

a water purifier is disposed on the second water inlet pipe.

* * * * *